US008810218B2

(12) United States Patent
Liu et al.

(10) Patent No.: US 8,810,218 B2
(45) Date of Patent: Aug. 19, 2014

(54) STABILIZED VOLTAGE REGULATOR

(75) Inventors: Yingyi Liu, Hefei (CN); Kun Lan, Hefei (CN); Chih-Chien Huang, Hsinchu (TW); Yu-Kai Chou, Hsinchu (TW)

(73) Assignee: Mediatek Singapore Pte. Ltd., Singapore (SG)

( * ) Notice: Subject to any disclaimer, the term of this patent is extended or adjusted under 35 U.S.C. 154(b) by 31 days.

(21) Appl. No.: 13/612,754

(22) Filed: Sep. 12, 2012

(65) Prior Publication Data

US 2013/0076325 A1 Mar. 28, 2013

(30) Foreign Application Priority Data

Sep. 27, 2011 (CN) ..... 2011 1 0297992

(51) Int. Cl.
*G05F 1/00* (2006.01)
*G05F 1/575* (2006.01)

(52) U.S. Cl.
CPC ..... *G05F 1/575* (2013.01)
USPC ..... 323/273; 323/280

(58) Field of Classification Search
CPC ..... G05F 1/10; G05F 1/575
USPC ..... 323/222–225, 269–277, 280–285
See application file for complete search history.

(56) References Cited

U.S. PATENT DOCUMENTS 5,218,323 A * 6/1993 Ohno ..... 330/290
5,747,975 A * 5/1998 Colandrea et al. ..... 323/276
5,861,736 A * 1/1999 Corsi et al. ..... 323/273
6,518,737 B1 * 2/2003 Stanescu et al. ..... 323/280
7,675,273 B2 * 3/2010 Ko et al. ..... 323/269
8,080,982 B2 * 12/2011 Lin et al. ..... 323/275
2003/0178976 A1 * 9/2003 Xi ..... 323/273
2005/0189930 A1 * 9/2005 Wu et al. ..... 323/280
2006/0197513 A1 * 9/2006 Tang et al. ..... 323/273
2008/0157735 A1 * 7/2008 Liu et al. ..... 323/280
2009/0001953 A1 * 1/2009 Huang ..... 323/281
2010/0052635 A1 * 3/2010 Wang ..... 323/280
2010/0066326 A1 * 3/2010 Huang ..... 323/282
2010/0109435 A1 * 5/2010 Ahmadi et al. ..... 307/31
2011/0002074 A1 * 1/2011 Chen ..... 361/88
2011/0181258 A1 * 7/2011 Ivanov et al. ..... 323/282
2012/0013396 A1 * 1/2012 Morino et al. ..... 327/540
2012/0126760 A1 * 5/2012 Vemula ..... 323/271
2013/0049870 A1 * 2/2013 Na et al. ..... 330/296
2013/0069608 A1 * 3/2013 Gakhar et al. ..... 323/273
2013/0222052 A1 * 8/2013 Gakhar et al. ..... 327/539

* cited by examiner

*Primary Examiner* — Timothy J Dole
*Assistant Examiner* — Yusef Ahmed
(74) *Attorney, Agent, or Firm* — McClure, Qualey & Rodack, LLP

(57) ABSTRACT

A voltage regulator includes a pass transistor, an operational amplifier and a voltage divider circuit. The pass transistor receives a supply voltage to generate a regulated output voltage according to a control signal. The operational amplifier generates the control signal according to a feedback voltage. The voltage divider circuit generates the feedback voltage at a feedback node according to the regulated output voltage, and includes a string of resistors and a stabilization element. The string of resistors is coupled to the pass transistor and includes multiple resistors. The stabilization element is coupled to the resistors and receives the regulated output voltage.

14 Claims, 4 Drawing Sheets

STABILIZED VOLTAGE REGULATOR

CROSS REFERENCE TO RELATED APPLICATIONS

This Application claims priority of China Patent Application No. 201110297992.5, filed on Sep. 27, 2011, the entirety of which is incorporated by reference herein.

BACKGROUND OF THE INVENTION

1. Field of the Invention

The disclosure relates to a low dropout (LDO) regulator, and more particularly to a LDO regulator with high stability.

2. Description of the Related Art

Voltage regulators are commonly used in the power management systems of computers, mobile phones, automobiles and many other electronic products. Generally, voltage regulators are configured to convert unstable power supply voltage into stable power supply voltage. A low dropout (LDO) regulator has a low input-to-output voltage difference between an input terminal where an unstable power supply voltage is inputted and an output terminal where a stable power supply voltage is outputted. "Dropout voltage" refers to the input-to-output voltage difference, whereby the regulator ceases to regulate against further reductions in the input voltage. Ideally, the dropout voltage should be as low as possible, to reduce the power consumption while still maintaining regulation performance.

In the conventional LDO regulator design, a low frequency pole, at about 200 KHz to 500 KHz, is usually generated at the feedback terminal Because the low frequency pole falls within the operation frequency band of the LDO regulator, the stability of the LDO regulator is seriously downgraded. However, stability is an important factor of the LDO regulator.

Therefore, a novel LDO regulator, which can push the pole to a high frequency band while still maintaining high stability, is highly required.

BRIEF SUMMARY OF THE INVENTION

Voltage regulators are provided. An embodiment of a voltage regulator comprises a pass transistor, an operational amplifier, and a voltage divider circuit. The pass transistor receives a supply voltage to generate a regulated output voltage according to a control signal. The operational amplifier generates the control signal according to a feedback voltage. The voltage divider circuit generates the feedback voltage at a feedback node according to the regulated output voltage. The voltage divider circuit comprises a string of resistors and a stabilization element. The string of resistors is coupled to the pass transistor and comprises a plurality of resistors. The stabilization element is coupled to the string of resistors and receives the regulated output voltage.

Another embodiment of a voltage regulator comprises a first transistor, an operational amplifier, and a voltage divider circuit. The first transistor receives a supply voltage to generate a regulated output voltage at an output node according to a control signal. The operational amplifier generates the control signal according to a difference between a reference voltage and a feedback voltage. The voltage divider circuit generates the feedback voltage at a feedback node according to the regulated output voltage. The voltage divider circuit comprises a string of resistors and a stabilization element. The string of resistors is coupled to the first transistor and comprises a plurality of resistors. The second transistor is coupled to the resistors and comprises a gate coupled to the output node.

Another embodiment of a voltage regulator comprises a pass transistor and a voltage divider circuit. The pass transistor receives a supply voltage to generate a regulated output voltage according to a control signal. The control signal is generated according to a feedback voltage. The voltage divider circuit generates the feedback voltage at a feedback node according to the regulated output voltage. The voltage divider circuit comprises a string of resistors and a stabilization element. The string of resistors is coupled to the pass transistor and comprising a plurality of resistors. The resistors and a plurality of parasitic capacitance generate a pole in a low frequency region at the feedback node. The stabilization element is coupled to the resistors and pushes the pole to a high frequency region.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
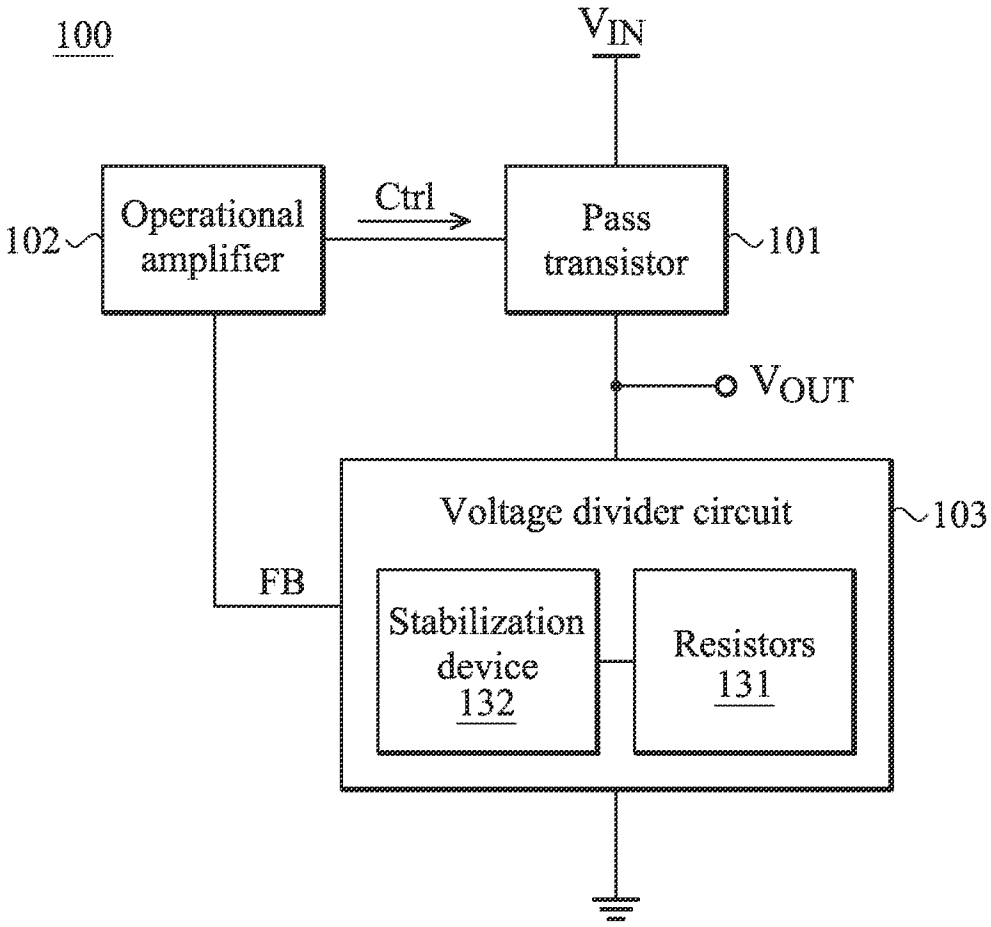
FIG. 1 shows a block diagram of a voltage regulator according to one embodiment of the invention.

FIG. 1 shows a block diagram of a voltage regulator 100 according to an embodiment of the invention. The voltage regulator 100 may be a low dropout (LDO) regulator in this embodiment, and may comprise a pass transistor 101, an operational amplifier 102, and a voltage divider circuit 103. The pass transistor 101 receives an unregulated supply voltage $V_{IN}$ and generates a regulated output voltage $V_{OUT}$ according to a control signal Ctrl. The voltage divider circuit 103 provides a feedback voltage at a feedback node FB according to the regulated output voltage $V_{OUT}$. The operational amplifier 102 is coupled to the feedback node FB and generates the control signal Ctrl according to the feedback voltage.

According to one embodiment of the invention, the voltage divider circuit 103 comprises a string of resistors 131 and a stabilization element 132. The string of resistors 131 comprises a plurality of resistors (not labeled). The stabilization element 132 is coupled to the resistors and comprises a control node (not shown) receiving the regulated output voltage $V_{OUT}$ for stabilizing operations of the voltage regulator 100. To be more specific, the stabilization element 132 generates a high frequency pole, with a frequency much higher than the operation frequency band of the voltage regulator, at the feedback node FB. The high frequency pole is generated by the stabilization element 132 by pushing a pole, which would cause the system to operate unstably in a conventional voltage regulator, to a high frequency region, so as to maintain the stability of the voltage regulator 100.

Figure 2:
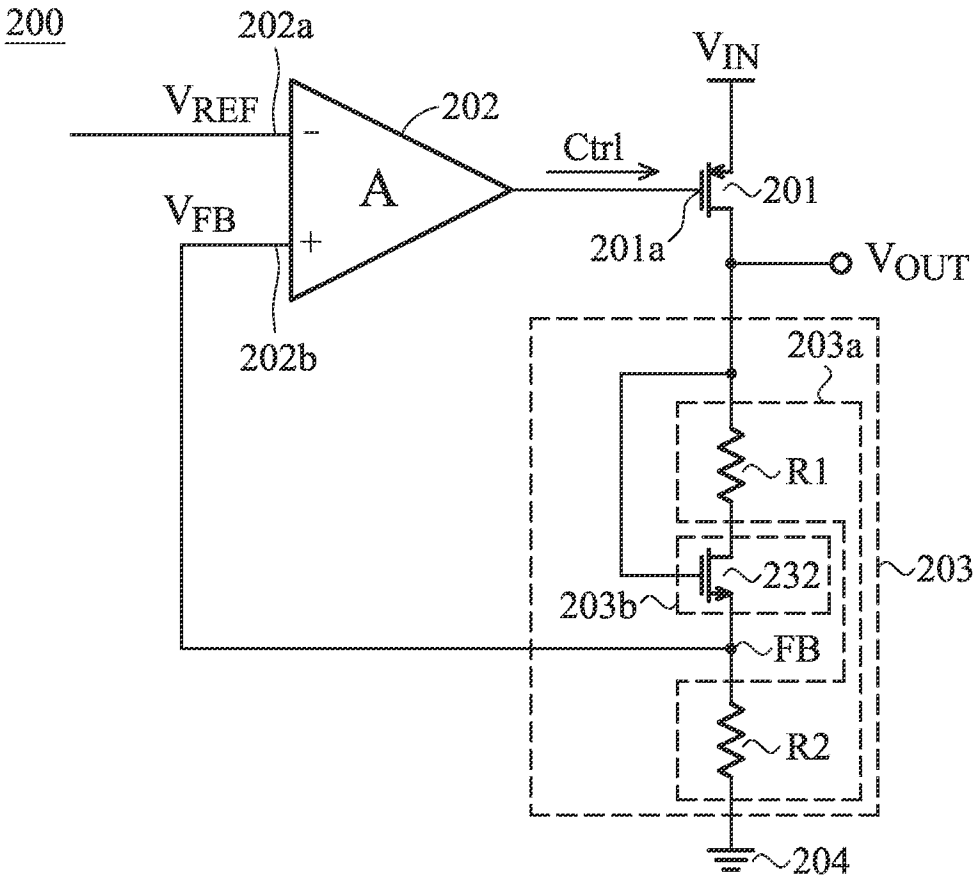
FIG. 2 shows a circuit diagram of a voltage regulator according to one embodiment of the invention.

FIG. 2 shows a circuit diagram of a voltage regulator 200 according to one embodiment, e.g. the embodiment shown as FIG. 1, of the invention. The voltage regulator 200 may be a low dropout (LDO) regulator, and may comprise a pass transistor 201, an operational amplifier 202, and a voltage divider circuit 203. The pass transistor 201 comprises a gate 201*a* coupled to the operational amplifier 202 for receiving the control signal Ctrl, and regulates the unregulated supply voltage V according to the control signal Ctrl, thereby generating the regulated output voltage $V_{OUT}$ at the output node (not labeled).

The operational amplifier 202 comprises two input nodes 202*a* and 202*b* for respectively receiving the reference voltage $V_{REF}$ and the feedback voltage $V_{FB}$, and generates the control signal Ctrl according to a difference between the reference voltage $V_{REF}$ and the feedback voltage $V_{FB}$. The voltage divider circuit 203 comprises a string of resistors 203*a* and a stabilization element 203*b*. The string of resistors 230*a* at least comprises resistors R1 and R2. The resistor R1 is coupled between the pass transistor 201 and the stabilization element 203*b*, the stabilization element 203*b* is coupled between the resistor R1 and the feedback node FB, and the resistor R2 is coupled between the feedback node FB and a ground node 204.

According to an embodiment of the invention, the stabilization element 203*b* may include, e.g. the transistor 232 shown in FIG. 2. The transistor 232 may be an N-type metal oxide semiconductor (NMOS) transistor. Note that because a gate (i.e. a control node) of the transistor 232 is coupled to the output node for receiving the regulated output voltage $V_{OUT}$, a gate voltage of the transistor 232 is increased to be higher than a drain voltage of the transistor 232. Because the gate-drain voltage difference is greater than the threshold voltage, the transistor 232 operates in a linear region.

Figure 3:
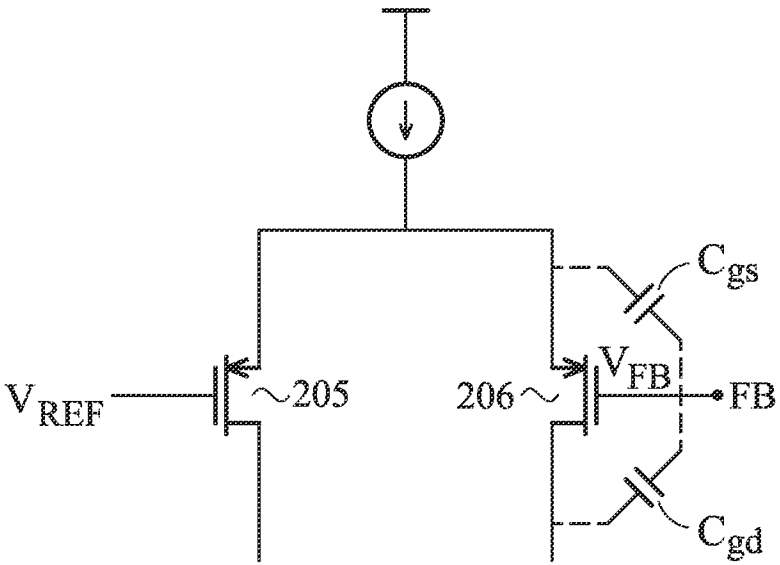
FIG. 3 shows a partial circuit diagram at an input nodes of an operational amplifier of the voltage regulator of FIG. 2.

FIG. 3 shows a partial circuit diagram for the input nodes 202*a* and 202*b* of the operational amplifier 202 according to the voltage regulator 200 of FIG. 2. The input nodes 202*a* and 202*b* of the operational amplifier 202 may comprise a differential MOS pair 205 and 206 and a plurality of parasitic capacitance, such as the parasitic capacitance Cgs and Cgd parasitized at the input nodes 202*a* and 202*b* of the operational amplifier 202 as shown in the figure. In general, in order to reduce the quiescent current, the resistors in the voltage divider circuit 203 are usually selected to have large resistance, such as several Mega-ohms. However, as shown in FIG. 2, because one input node (e.g. 202*b*) of the operational amplifier 202 is coupled to the voltage divider circuit 203 at the feedback node FB, if there is no stabilization element 203*b* coupled to the feedback node FB, a pole in a low frequency region (low frequency pole) would be created at the feedback node FB by the mutually coupled parasitic capacitance and the resistors, wherein the frequency of the low frequency pole would be:

$$\omega = \frac{1}{(R_1 \| R_2) \times (C_{gs} + C_{gd})} \quad \text{Eq. 1}$$

where the $R_1$ represents the resistance of the resistor R1, the $R_2$ represents the resistance of the resistor R2, the $C_{gs}$ represents the capacitance of the capacitor Cgs, and the $C_{gd}$ represents the capacitance of the capacitor Cgd.

Suppose that $R_1=R_2=1M\Omega$ and $C_{gs}=C_{gd}=500$ fF, the frequency of the pole as derived from Eq. 1 would be 300 KHz. Because an operation frequency band of a voltage regulator is generally distributed from 200 KHz to 500 KHz, the low frequency pole would seriously affect the stability of the voltage regulator 200 if there is no stabilization element 203*b*.

Therefore, in one embodiment of the invention, the transistor 232 is coupled at the feedback node FB so as to stabilize the operations of the voltage regulator 200. As previously described, because the transistor 232 operates in the linear region, the turn-on resistance $r_{ON}$ of the transistor 232 is very small. Therefore, the transistor 232 may be regarded as a small resistor for direct current (DC) and barely affect the DC component in the regulated output voltage $V_{OUT}$. In another perspective, regarding the alternative current (AC) component, the transistor 232 may further reduce the resistance at the feedback node FB when looking upward from the feedback node FB, thereby pushing the pole (that is, the above-mentioned low frequency pole), created by the parasitic capacitance Cgs and Cgd and at the feedback node FB, from the low frequency region to the high frequency region.

Figure 4:
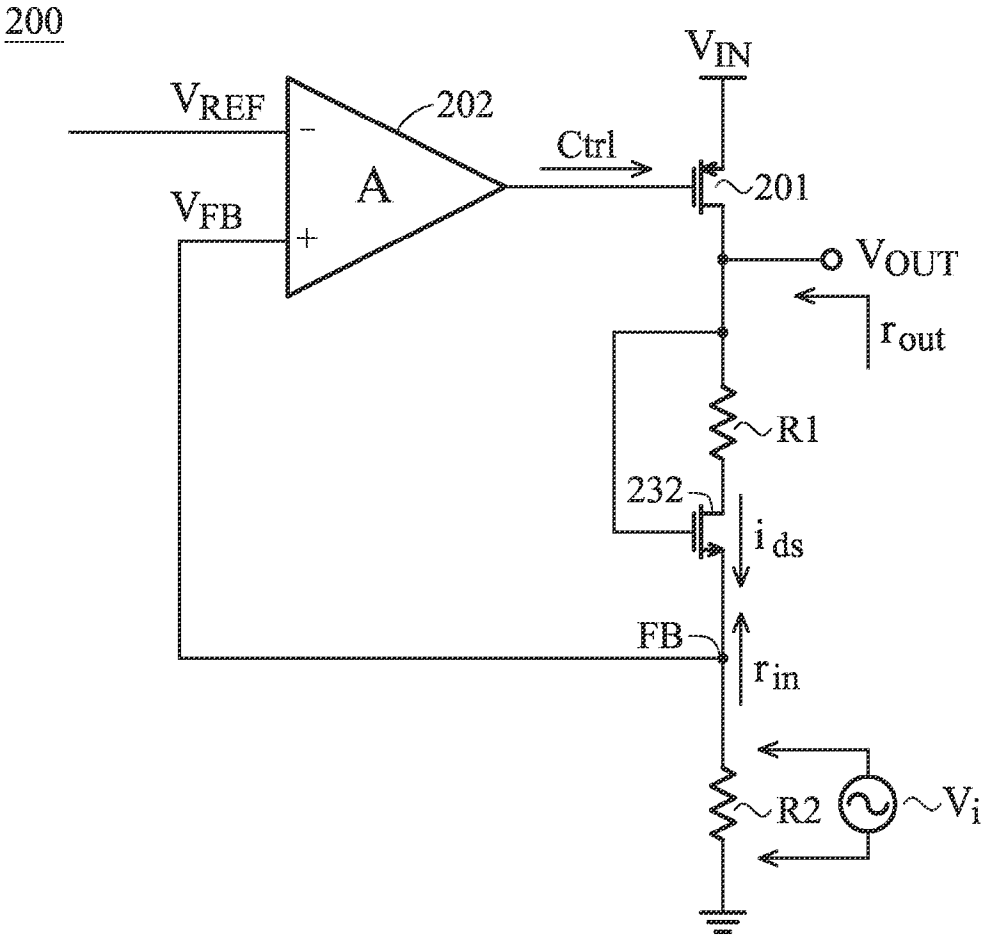
FIG. 4 is a schematic diagram showing alternative current (AC) signal analysis results of the voltage regulator of FIG. 2.

FIG. 4 is a schematic diagram showing the AC signal analysis results according to the embodiment of FIG. 2. As shown in FIG. 4, when an AC voltage $V_i$ is connected to the resistor R2, the AC component in the control signal at the gate of the pass transistor 201 is $(A \times V_i)$, where A represents a gain of the operational amplifier 202. The AC component in the regulated output voltage $V_{OUT\ is\ (-Vi} \times A \times gm \times r_{out})$, where $r_{out}$ represents the resistance looking from the output node into the voltage regulator 200 and gm represents the transconductance of the pass transistor 201. In addition, a gate-source voltage of the transistor 232 is $V_{gs}=[(-V_i \times A \times gm \times r_{out})-V_i]$.

Based on the values derived above, the drain-source current of the transistor 232 may be:

$$i_{ds} = \mu \times C_{ox} \times \frac{W}{L}(-V_i \times A \times gm \times r_{out} - V_i - V_{th}) \cong -\mu \times C_{ox} \times \frac{W}{L}(V_i \times A \times gm \times r_{out}) \quad \text{Eq. 2}$$

where $V_{th}$ is the threshold voltage of the transistor 232, μ is the charge carrier effective mobility, $C_{ox}$ is the unit capacitance of the gate oxide, W is the gate width of the transistor 232 and L is the gate length of the transistor 232.

The input impedance of the AC voltage $V_i$ may further be derived from Eq. 2 as:

$$r_{in} = \frac{V_i}{\mu \times C_{ox} \times \frac{W}{L}(V_i \times A \times gm \times r_{out})} = \frac{1}{\mu \times C_{ox} \times \frac{W}{L} \times A \times gm \times r_{out}} \quad \text{Eq. 3}$$

where $r_{in}$ is the input impedance of the transistor 232 when looking upward from the feedback node FB. Because the gain A and the transconductance gm are generally very large, the input impedance $r_{in}$ is very small as shown in Eq. 3, when the transistor 232 is coupled to the feedback node FB, the frequency of the low frequency pole created at the feedback node FB becomes:

$$\omega = \frac{1}{(r_{in} \| R_2) \times (C_{gs} + C_{gd})} \quad \text{Eq. 4}$$

As shown in Eq. 4, because the input impedance $r_{in}$ is very small, the low frequency pole created at the feedback node FB will be pushed to a high frequency region and becomes a high frequency pole. Since the frequency of the high frequency pole is much higher than the operation frequency band (as described above, usually in several KHz) of the voltage regulator 200, the high frequency pole will not affect the stability of the voltage regulator 200. In addition, because the circuit area required for a transistor is small, the increased circuit area due to the addition of the transistors, as the stabilization element 203*b* to the voltage regulator 200, is small. Note that in another embodiment of the invention, the stabilization element 203*b* may also comprise more than one transistor. By taking the programmable advantages of the transistors, the stability and the ability to resist process variation may further be improved. In addition, the gate of the transistor 232 may not have to be directly connected to the output node $V_{OUT}$ as shown in FIG. 2 and FIG. 4. For example, an electrostatic discharge protection circuit may be coupled to the control node (i.e. between the gate of the transistor 232 and the output node $V_{OUT}$) of the stabilization element 132.

While the invention has been described by way of example and in terms of preferred embodiment, it is to be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. A voltage regulator, comprising:

a pass transistor, receiving a supply voltage to generate a regulated output voltage according to a control signal;

an operational amplifier, generating the control signal according to a feedback voltage;

wherein the operational amplifier comprises:

a first input node, receiving a reference voltage;

a second input node, receiving the feedback voltage; and an output node, outputting the control signal, wherein the operational amplifier is coupled to the stabilization element at the feedback node, and a high frequency pole is generated at the second input node by the stabilization element and a plurality of parasitic capacitance; and a voltage divider circuit, generating the feedback voltage at a feedback node according to the regulated output voltage, wherein the voltage divider circuit comprises:

a string of resistors, coupled to the pass transistor and comprising a plurality of resistors, wherein the plurality of resistors and the plurality of parasitic capacitance generate a pole in a low frequency region at the feedback node; and a stabilization element, coupled to the string of resistors and receiving the regulated output voltage to stabilize the regulated output voltage affected by the pole.

2. The voltage regulator as claimed in claim 1, wherein the stabilization element generates a high frequency pole at the feedback node.

3. The voltage regulator as claimed in claim 1, wherein the plurality of resistors comprises a first resistor and a second resistor, the first resistor is coupled between the pass transistor and the stabilization element, the stabilization element is coupled between the first resistor and the feedback node, and the second resistor is coupled between the feedback node and a ground node.

4. The voltage regulator as claimed in claim 1, wherein the stabilization element comprises a transistor operating in a linear region.

5. The voltage regulator as claimed in claim 1, wherein the stabilization element comprises an NMOS transistor.

6. The voltage regulator as claimed in claim 1, wherein the operational amplifier generates the control signal according to a difference between the reference voltage and the feedback voltage.

7. A voltage regulator, comprising:

a first transistor, receiving a supply voltage to generate a regulated output voltage at an output node according to a control signal;

an operational amplifier, generating the control signal according to a difference between a reference voltage and a feedback voltage;

wherein the operational amplifier comprises:

a first input node, receiving the reference voltage;

a second input node, receiving the feedback voltage; and an output node, outputting the control signal, wherein the operational amplifier is coupled to the second transistor at the second input node, and a high frequency pole is generated at the second input node by a plurality of parasitic capacitance of the second transistor; and a voltage divider circuit, generating the feedback voltage at a feedback node according to the regulated output voltage, wherein the voltage divider circuit comprises:

a string of resistors, coupled to the first transistor and comprising a plurality of resistors, wherein the plurality of resistors and the plurality of parasitic capacitance generate a pole in a low frequency region at the feedback node; and a second transistor, coupled to the string of resistors and comprising a gate coupled to the output node to stabilize the regulated output voltage affected by the pole.

8. The voltage regulator as claimed in claim 7, wherein the plurality of resistors comprise a first resistor and a second resistor, the first resistor is coupled between the first transistor and the second transistor, the second transistor is coupled between the first resistor and the feedback node, and the second resistor is coupled between the feedback node and a ground node.

9. The voltage regulator as claimed in claim 7, wherein the second transistor operates in a linear region.

10. The voltage regulator as claimed in claim 7, wherein the second transistor is an NMOS transistor.

11. A voltage regulator, comprising:

a pass transistor, receiving a supply voltage to generate a regulated output voltage according to a control signal, wherein the control signal is generated according to a feedback voltage;

a voltage divider circuit, generating the feedback voltage at a feedback node according to the regulated output voltage, wherein the voltage divider circuit comprises:

a string of resistors, coupled to the pass transistor and comprising a plurality of resistors, wherein the plurality of resistors and a plurality of parasitic capacitance generate a pole in a low frequency region at the feedback node;

a stabilization element, coupled to the string of resistors and pushing the pole to a high frequency region; and an operational amplifier, receiving the feedback voltage and a reference voltage, and generating the control signal according to a difference between the reference voltage and the feedback voltage, wherein the operational amplifier comprises:

a first input node, receiving the reference voltage;

a second input node, receiving the feedback voltage; and an output node, outputting the control signal, wherein the operational amplifier is coupled to the stabilization element at the second input node.

12. The voltage regulator as claimed in claim 11, wherein the plurality of resistors comprise a first resistor and a second resistor, the first resistor is coupled between the pass transistor and the stabilization element, the stabilization element is coupled between the first resistor and the feedback node, and the second resistor is coupled between the feedback node and a ground node.

13. The voltage regulator as claimed in claim 11, wherein the stabilization element comprises a transistor operating in a linear region.

14. The voltage regulator as claimed in claim 11, wherein the stabilization element comprises an NMOS transistor.

* * * * *